US005140313A

United States Patent [19]

Wen

[11] Patent Number: 5,140,313

[45] Date of Patent: Aug. 18, 1992

[54] JOY STICK ASSEMBLY

[76] Inventor: O Che Wen, No. 77, An Shun Tung Chi St., Taichung, Taiwan

[21] Appl. No.: 642,505

[22] Filed: Jan. 17, 1991

[51] Int. Cl.[5] ..... G09G 3/02

[52] U.S. Cl. ..... 340/709; 340/706; 74/471 X Y; 200/6 A

[58] Field of Search ..... 340/709, 706; 74/471 X Y, 529; 200/6 A; 273/148 B, DIG. 28

[56] References Cited

U.S. PATENT DOCUMENTS

| | | | |
|---|---|---|---|
| 3,827,313 | 8/1974 | Kiessling | 74/529 |
| 3,828,148 | 8/1974 | Roeser | 200/6 A |
| 4,646,087 | 2/1987 | Schumann | 74/471 X Y |
| 4,784,008 | 11/1988 | Paquereau et al. | 200/6 A |
| 5,043,709 | 8/1991 | Kim | 340/709 |

*Primary Examiner*—Jeffery A. Brier
*Assistant Examiner*—Regina Lang
*Attorney, Agent, or Firm*—Townsend and Townsend

[57] ABSTRACT

A joy stick includes a base, and a post having a lower portion extending through a retainer which is rotatable about the base. A spring is biased between the post and the retainer, and another spring is biased between the base and the post so that the post is biased upward relative to the retainer and the base. Four switches have blades disposed beside the lower portion of the post. The blades can be depressed by the lower portion of the post. When the post is depressed, the depression force on the post can be balanced by the springs so that the joy stick will not be worn out very quick and can endure longer.

5 Claims, 5 Drawing Sheets

JOY STICK ASSEMBLY

FIELD OF THE INVENTION

The present invention relates to a joy stick assembly for a computer and the like.

BACKGROUND OF THE INVENTION

Generally, the lower end of a stem of a joy stick is supported by a spring whose lower end is not stably held or supported so that the spring is usually separated from the stem of the joy stick which causes failure of the joy stick. The working life of the joy stick is short.

The present invention has arisen to mitigate and/or obviate the afore-described disadvantages of the conventional joy stick.

SUMMARY OF THE INVENTION

The primary objective of the present invention is to provide a joy stick assembly which can be operated easily and which has a long working life.

In accordance with one aspect of the invention, there is provided a joy stick which includes a base and a post swingably supported on the base. A semi-spherical recess is formed in the base for receiving a retainer so that the retainer is rotatable. The post has a lower portion extending through the center of the retainer and extending downward beyond the retainer. A shoulder is formed in a middle portion of the post, and a spring is biased between the shoulder of the post and the retainer so that the post is biased upward relative to the retainer. Four switches are fixed to a bottom of the base. The switches have blades disposed and distributed on side portions of the sleeve. The blades can be depressed by the sleeve when the post is swung or rotated. When the post is depressed by a user, the depression force on the post can be balanced by the spring so that the joy stick will not be worn out very quick and can endure longer.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
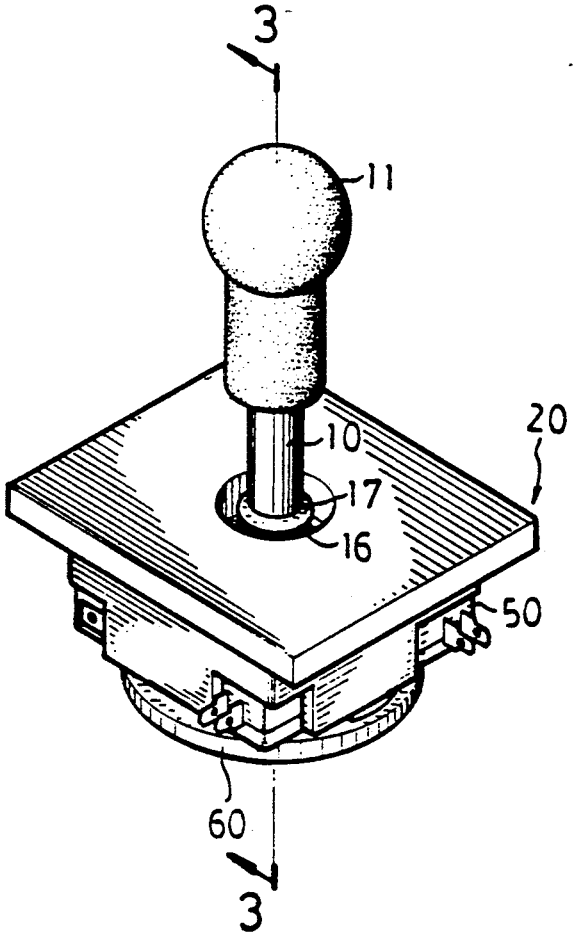
FIG. 1 is a perspective view of a joy stick assembly in accordance with the present invention.

Referring to the drawings and initially to FIG. 1, a joy stick assembly in accordance with the present invention comprises a post 10 swingably supported on a base 20; and four switches 50, such as microswitches 50, disposed on the bottom of the base 20.

Figure 2:
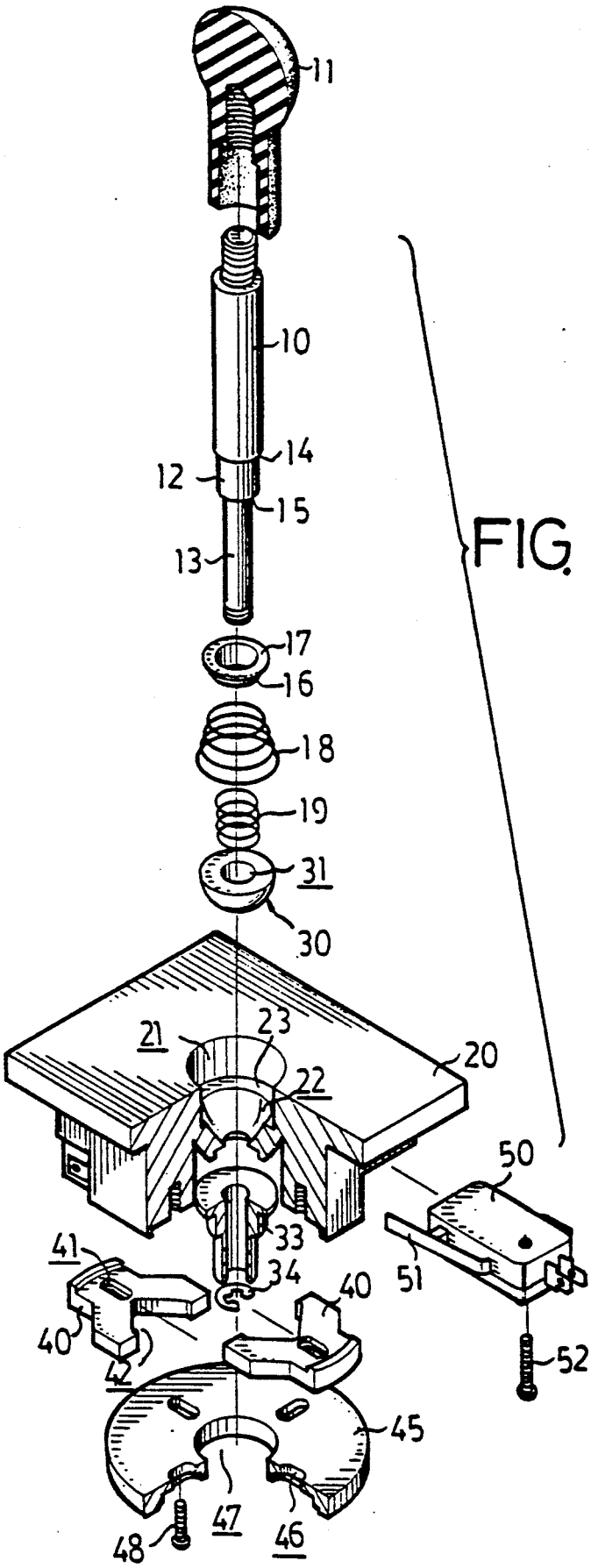
FIG. 2 is an exploded view of the joy stick.
Figure 3:
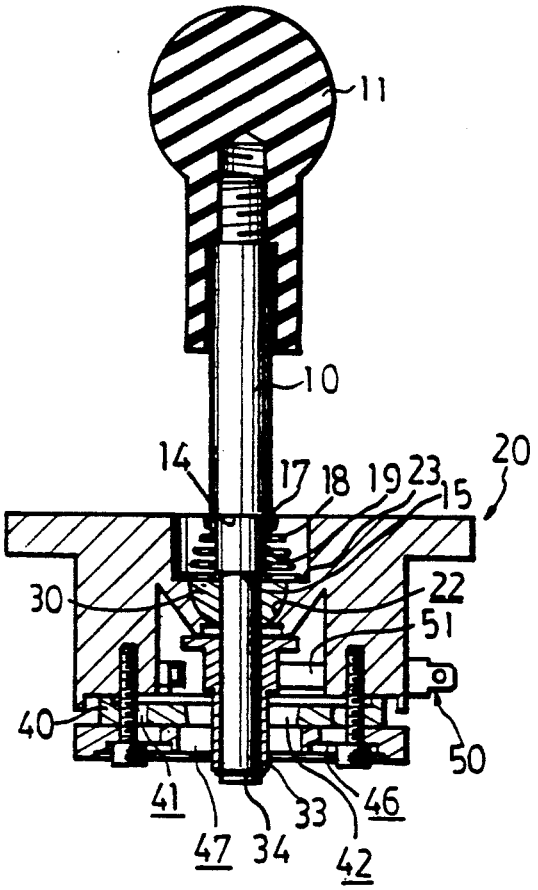
FIGS. 3 and 4 are cross sectional view of the joy stick assembly taken along lines 3—3 of FIG. 1.

Referring next to FIGS. 2 and 3, a knob 11 is provided on the upper end of the post 10. Two sections 12, 13 which have reduced diameters are formed in consecutive on the lower end portion of the post 10 so that two shoulders 14, 15 are formed. A ring 16 which has an annular flange 17 formed on the upper end and extended outward therefrom is engaged on the middle section 12 and is engaged with the shoulder 14. Two springs 18, 19 are provided on the post 10. A retainer 30 which is semi-spherical has a hole 31 formed in the center thereof for receiving the lower section 13 of the post 10. The outer diameter of the middle section 12 is larger than the inner diameter of the hole 31 of the retainer 30 so that the middle section 12 can not move into the hole 31 of the retainer 30 and so that the engagement between the shoulder 15 and the upper surface of the retainer 30 limits a relative movement between post 10 and the retainer 30. The spring 19 is biased between the lower end of the ring 16 and the upper surface of the retainer 30 so that the post 10 is biased upward relative to the retainer 30.

Figure 4:
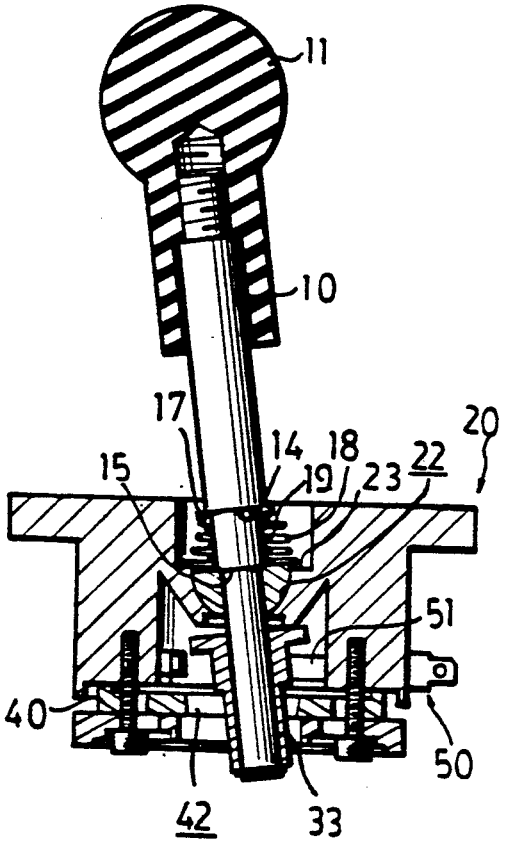

A cylindrical recess 21 and a semi-spherical recess 22 are formed in the upper and middle portion of the base 20 and a shoulder 23 is formed between the two recesses 21, 22. The retainer 30 is received in the semi-spherical recess 22 of the base 20 so that the retainer 30 and the post 10 are swingably supported, as shown in FIG. 4. The spring 18 is biased between the annular flange 17 of the ring 16 and the shoulder 23 so that the post 10 is biased upward relative to the base 20. A sleeve 33 is engaged on the lower end of the section 13 of the post 10, and a retaining ring 34 is fixed on the bottom of the post 10 so that the sleeve 33 can be supported in place.

A pair of stops 40, each is Y-shaped and each has an oblong hole 41 formed therein. A notch 42 is formed in the inner side of each of the stops 40. Four oblong holes 46 which are equally spaced are formed in a disc 45 which has a center hole 47 formed therein. The stops 40 and the disc 45 are fixed to the bottom of the base 20 by such as bolts 48. The stops 40 can be stably held in place by the disc 45. The stops 40 can be guided to move relative to the bolt 48 by the engagement between the oblong holes 41 and the bolts 48 so that the notches 42 of the stops 40 can form a square when the stops 40 move toward the center of the base 20 and when the inner sides of the stops 40 contact with each other, as shown in solid lines in FIG. 5. When the square which is formed by the notches 42 of the stops 40 is formed, the movement of the lower end of the post 10 will be restricted by the square.

Figure 5:
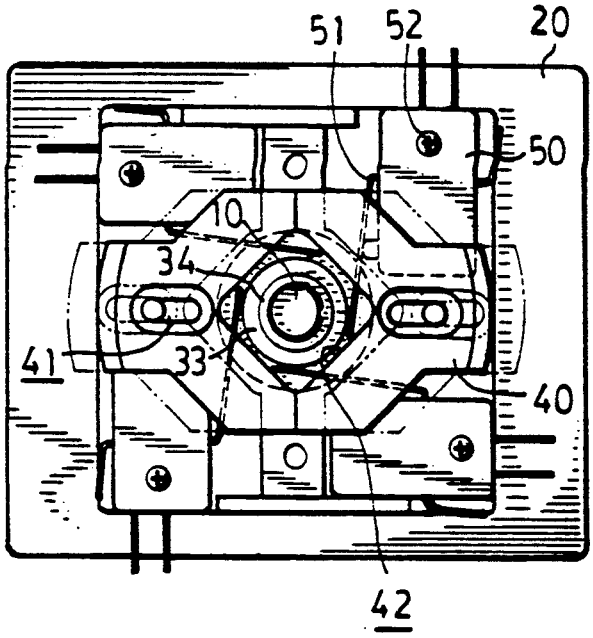
FIG. 5 is a bottom view of the joy stick assembly, in which, for clearly illustration purposes, a disc is removed.

Each of the switches 50 has a resilient blade 51 and is fixed to the bottom of the base 20 by such as bolt 52. The switches 50 are actuated when the blades 51 are depressed. The hole 47 of the disc 45 limits the movement of the sleeve 33 so that the blades 51 will not be overdepressed. As shown in FIG. 5, the free end portions of the blades 51 of the switches 50 are located at the corner areas of the square which is formed by the notches 42 of the stops 40 so that only one of the blades 51 can be depressed by the sleeve 33 at a time when the square is formed; i.e., the square limits the sleeve to depress only one of the blades at a time. However, when the bolts 48 are loosed and when the know 11 of the post 10 is rotated, the stops 40 can be pushed outward by the sleeve 33 toward the position as shown in dotted lines in FIG. 5 so that the movement of the sleeve 33 will not be limited by the notches 42 of the stops 40 and can swing and rotate freely. At this moment, two adjacent blades 51 can be depressed by the sleeve 33 at a time when the sleeve 33 moves toward the position between the two adjacent blades 51.

In operation, referring again to FIGS. 3, 4 and 5, when the stops 40 are pushed toward each other so that the square is formed and when the knob 11 of the post 10 is either swung, rotated or moved, only one of the blades 51 can be depressed by the sleeve 33 at a time so that the cursor of a computer (not shown) can only move either right, left, up or down. However, when the stops 40 are pushed outward and are separated from each other, two adjacent blades 51 can be depressed by the sleeve 33 at a time so that the cursor can move in another direction other than right, left, up or down.

When in operation, the joy stick will usually be depressed downward very hard by the user. However, as shown in FIGS. 3 and 4, the post 10 is pushed upward relative to the base 20 by both of the springs 18, 19 so that spring forces of the springs 18, 19 may balance a large amount of the depression force so that the parts of the joy stick will not be worn out very quick and can endure longer. In addition, the shoulder 15 limits the downward movement of the post 10 relative to the base 10 and the retainer 30 so that the compression of the springs 18 and 19 is limited in order that the springs 18 and 19 will not be compressed beyond the endurance limit. Accordingly, the working life of the springs and the joy stick is increased.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A joy stick assembly comprising a base, a first recess which is semi-spherical being formed in a middle portion of said base; a retainer which is semi-spherical being received in said first recess so that said retainer is rotatable, a hole being formed in a center of said retainer; a post having a lower portion extending through said hole of said retainer and extending downward beyond said retainer, a first shoulder being formed in a middle portion of said post; a first spring being biased between said first shoulder of said post and an upper surface of said retainer so that said post is biased upward relative to said retainer; a sleeve being coupled to said lower portion of said post; and four switches being fixed to a bottom of said base, each of said switches having a blade provided thereon, said blades of said switches being disposed and distributed on side portions of said sleeve and can be depressed by said sleeve when said post is swung or rotated; and when said post is depressed by a user, the depression force on said post can be balanced by said first spring so that said joy stick will not be worn out very quick and can endure longer.

2. A joy stick assembly according to claim 1, wherein a second shoulder which is formed on said post is located below said first shoulder and is located slightly above said upper surface of said retainer so that the downward movement of said post is limited when said second shoulder is engaged with said upper surface of said retainer, and so that said first spring will not be overcompressed.

3. A joy stick assembly according to claim 1, wherein a ring which has an annular flange extended outward from an upper end thereof is engaged on said first shoulder of said post, a second recess is formed above said first recess and a third shoulder is formed between said first recess and said second recess, and a second spring is biased between said annular flange of said ring and said third shoulder so that said post is further biased upward relative to said base and so that said joy stick will not be worn out very quick and can endure longer.

4. A joy stick assembly according to claim 1, wherein a pair of stops are fixed to the bottom of said base, each of said stops has an oblong hole formed therein, a bolt extends through each of said oblong holes and is threaded to the bottom of said base so that said stops can be guided to move by an engagement between said bolt and said oblong hole, a notch is formed in an inner side of each of said stops, said notches form a square when said stops move toward each other and when said stops contact with each other, a free end of each of said blades is located at a corner area of said square so that only one of said blades can be depressed by said sleeve at a time.

5. A joy stick assembly according to claim 4, wherein a disc is further fixed to said bottom of said base so that said stops are fixed between said bottom of said base and said disc and so that said stops can be stably held in place by said disc, a center hole is formed in said disc, said sleeve extends through said center hole so that the movement of said sleeve is limited, and said center hole is arranged such that said blades will not be overdepressed by said sleeve.

* * * * *